US009304524B2

(12) United States Patent
Thakur

(10) Patent No.: US 9,304,524 B2
(45) Date of Patent: Apr. 5, 2016

(54) VOLTAGE REGULATION SYSTEM FOR INTEGRATED CIRCUIT

(71) Applicant: Nishant Singh Thakur, Indore (IN)

(72) Inventor: Nishant Singh Thakur, Indore (IN)

(73) Assignee: FREESCALE SEMICONDUCTOR, INC., Austin, TX (US)

( * ) Notice: Subject to any disclaimer, the term of this patent is extended or adjusted under 35 U.S.C. 154(b) by 45 days.

(21) Appl. No.: 14/467,037

(22) Filed: Aug. 24, 2014

(65) Prior Publication Data

US 2016/0054746 A1 Feb. 25, 2016

(51) Int. Cl.
*G05F 1/10* (2006.01)
*G05F 3/02* (2006.01)
*G05F 1/46* (2006.01)

(52) U.S. Cl.
CPC ..... *G05F 1/468* (2013.01)

(58) Field of Classification Search
CPC ..... G05F 3/262; G05F 3/265; G05F 3/30; G05F 3/205; G11C 5/147
USPC ..... 327/530, 538
See application file for complete search history.

(56) References Cited

U.S. PATENT DOCUMENTS

| | | | | |
|---|---|---|---|---|
| 5,977,757 | A * | 11/1999 | Felps | 323/282 |
| 6,580,256 | B1 * | 6/2003 | Martindale et al. | 323/280 |
| 7,397,228 | B2 | 7/2008 | Barrows | |
| 8,080,897 | B1 | 12/2011 | Virutchapunt | |
| 8,779,747 | B2 * | 7/2014 | Su et al. | 323/285 |
| 8,928,397 | B2 * | 1/2015 | Kodera et al. | 327/538 |
| 2005/0023705 | A1 * | 2/2005 | Campbell et al. | 257/786 |
| 2010/0127676 | A1 * | 5/2010 | Yamazaki et al. | 323/282 |
| 2013/0093505 | A1 | 4/2013 | Gupta et al. | |

* cited by examiner

*Primary Examiner* — Quan Tra
(74) *Attorney, Agent, or Firm* — Charles E. Bergere

(57) ABSTRACT

An integrated circuit (IC) includes a power grid having first, through fourth nodes for receiving first supply, first ground, second supply, and second ground voltage signals, respectively, a voltage regulator, a reference voltage calibration circuit, a dual-rail sense circuit, and a voltage monitor circuit. The reference voltage calibration circuit receives the first supply, first ground, second supply, and second ground voltage signals and generates a reference voltage signal based on differences between voltage levels of the first supply and ground voltage signals, and the second supply and ground voltage signals. The voltage regulator regulates the first supply voltage signal based on the reference voltage signal and the second supply voltage signal. The dual-rail sense circuit generates a sense signal based on the second supply and ground voltage signals. The voltage monitor generates a voltage monitor signal based on the sense signal that indicates a state of the IC.

14 Claims, 7 Drawing Sheets

VOLTAGE REGULATION SYSTEM FOR INTEGRATED CIRCUIT

BACKGROUND OF THE INVENTION

The present invention relates generally to integrated circuits, and, more particularly, to a system for voltage regulation and monitoring in an integrated circuit.

With the advent of micron-sized integrated circuits (ICs), power and ground grid size and IR drop of the ICs are increasing. Typically, an IC is powered by a supply voltage signal that is transmitted over a power grid to various logic circuits of the IC, while a ground grid supplies a ground voltage signal to the logic circuits. Each logic circuit is connected between nodes of the power and ground grids. Different nodes of the power grid are connected to each other by way of electronic components, such as inductors, capacitors, resistors, and so on. Similarly, different nodes of the ground grid are connected to each other by way of the electronic components. The supply voltage signal is first received by the IC at a first node of the power grid, sometimes called a supply cold point. There is minimum IR drop in a first voltage level of the supply voltage signal received at the supply cold point. The supply voltage signal is transmitted through the components of the power grid, which cause IR drop in the first voltage level of the supply voltage signal. As a result, the supply voltage signal received at a second node of the power grid, i.e., a supply hot point, has a second voltage level that is less than the first voltage level by a voltage level equivalent to the IR drop at the supply hot point. Similarly, a ground voltage signal is first received by the IC at a first node of the ground grid (a 'ground cold point'). There is minimum IR drop in a first voltage level of the ground voltage signal received at the ground cold point. The ground voltage signal is transmitted through the components of the ground grid, which cause a rise in the first voltage level of the ground voltage signal due to the IR drop. As a result, the ground voltage signal received at a second node of the ground grid, i.e., a ground hot point, has a second voltage level that is greater than the first voltage level of the ground voltage signal by a voltage level equivalent to the IR drop at the ground hot point.

Typically, the first and second voltage levels of the supply voltage signal must be within a predetermined voltage range. If the first voltage level of the supply voltage signal at the supply cold point exceeds the highest voltage level of the predetermined voltage range, reliability and aging specifications of the IC can fail, which can result in damage to the IC. Similarly, if the second voltage level of the supply voltage signal at the supply hot point is less than the lowest voltage level of the predetermined voltage range, timing of critical paths of the IC can be affected, thereby increasing functional timing of the IC. A difference between the highest and lowest voltage levels of the supply voltage signal supplied to the IC is shrinking with the decreasing size of the ICs. Hence, voltage monitoring and regulator circuits have to be included in the IC to monitor and regulate the first and second voltage levels of the supply voltage signal.

Voltage monitoring circuits, such as high voltage detectors (HVD), low voltage detectors (LVD), and power on reset (POR) monitors are included in the IC to monitor the second voltage level of the supply voltage signal at the supply hot point. The voltage monitoring circuit has a first input terminal connected to the supply hot point for receiving the supply voltage signal received at the supply hot point and a second input terminal for receiving a first reference voltage signal. The voltage monitoring circuit generates a monitor signal at its output terminal that indicates at least one of a low voltage and POR states of the IC when the second voltage level of the supply voltage signal drops below the voltage level of the first reference voltage signal. The monitor signal indicates a high voltage state of the IC when the first voltage level of the supply voltage signal exceeds the voltage level of the first reference voltage signal. During normal operation of the IC, the lowest voltage level of the predetermined voltage range must be maintained across a logic circuit connected between the supply and ground hot points. However, the first input terminal of the voltage monitoring circuit senses only the second voltage level of the supply voltage signal received at the supply hot point, so it doesn't account for the rise in the first voltage level of the ground voltage signal at the ground hot point. As a result, the voltage monitoring circuit gives a false indication of the high and low voltage states of the IC by way of the monitor signal.

One way to overcome this problem is to increase the voltage level of the first reference voltage signal of the voltage monitoring circuit by a voltage level equal to the IR drop at the ground hot point. The voltage monitoring circuit then correctly indicates the high and low voltage states of the IC as the IR drop at the ground hot point is now accounted for. However, increasing the voltage level of the first reference voltage signal increases the power consumption of the IC. Also, the IR drop at the ground hot point may change based such that the voltage level of the first reference voltage signal will have to be changed on the fly.

A voltage regulator is included in the IC to provide the supply voltage signal to the supply cold point and regulate the first and second voltage levels of the supply voltage signal within the predetermined voltage range. The voltage regulator has a first input terminal connected to the supply hot point for receiving the supply voltage signal and a second input terminal for receiving a second reference voltage signal. The voltage regulator provides the supply voltage signal having the first voltage level to the supply cold point after regulating the first voltage level based on a voltage level of the second reference voltage signal. However, the first input terminal of the voltage regulator senses only the second voltage level of the supply voltage signal received at the supply hot point, so it doesn't account for the rise in the first voltage level of the ground voltage signal at the ground hot point. As a result, the first voltage level of the supply voltage signal is incorrectly regulated and may not be within the predetermined voltage range. Moreover, due to regulator-load regulation, the first voltage level of the supply voltage signal changes when a load current of the voltage regulator changes, which increases an output spread of the voltage regulator and impacts the regulator accuracy. Thus, regulation of the first voltage level of the supply voltage signal within the predetermined voltage range is difficult.

Therefore, it would be advantageous to have an IC that includes a high precision voltage monitoring circuit and a voltage regulator circuit with very low variation in the output voltage signal.

BRIEF DESCRIPTION OF THE DRAWINGS

The following detailed description of the preferred embodiments of the present invention will be better understood when read in conjunction with the appended drawings. The present invention is illustrated by way of example, and not limited by the accompanying figures, in which like references indicate similar elements.

DETAILED DESCRIPTION OF THE INVENTION

Figure 1:
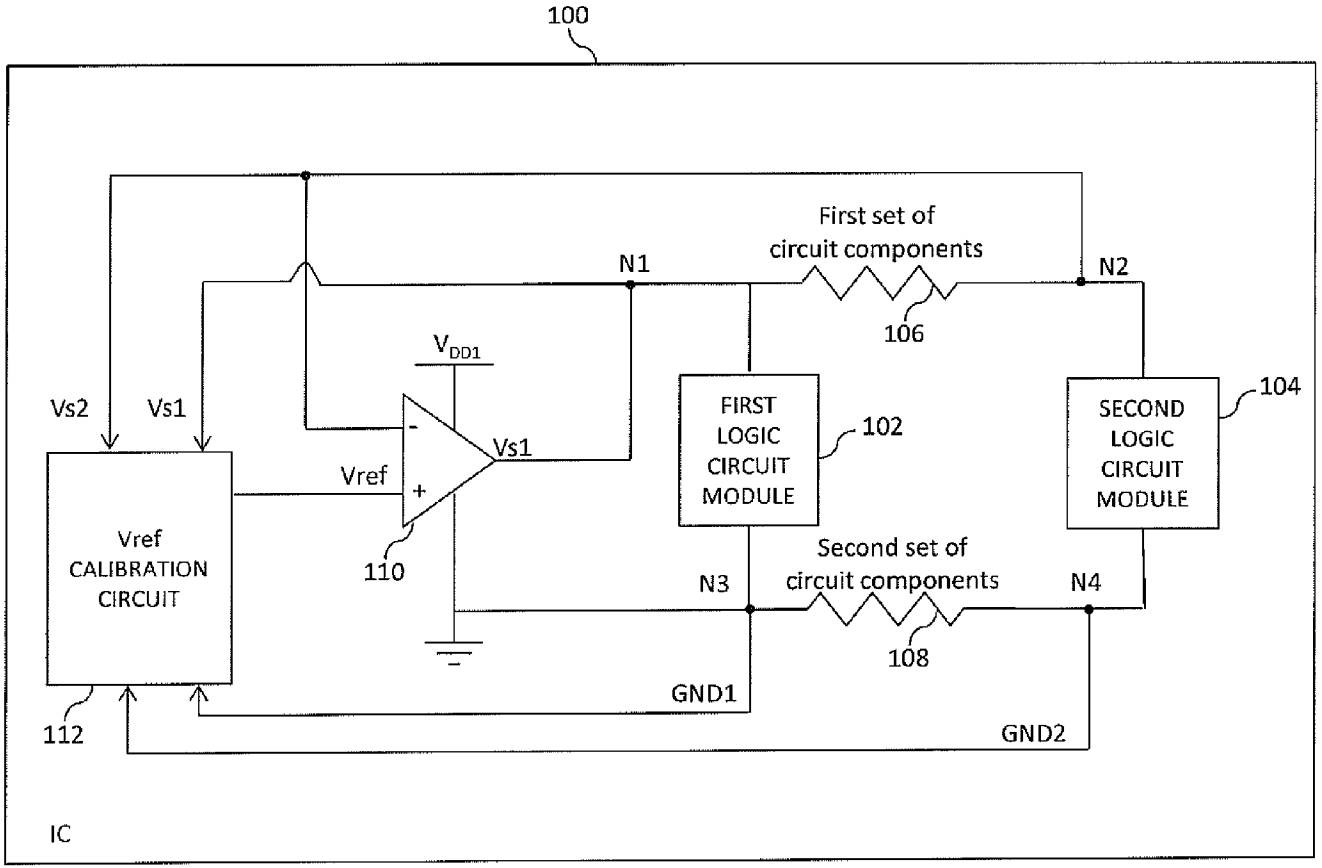
FIG. 1 is a schematic block diagram of an integrated circuit (IC) for voltage regulation in accordance with an embodiment of the present invention.

The detailed description of the appended drawings is intended as a description of the currently preferred embodiments of the present invention, and is not intended to represent the only form in which the present invention may be practiced. It is to be understood that the same or equivalent functions may be accomplished by different embodiments that are intended to be encompassed within the spirit and scope of the present invention.

In one embodiment of the present invention, an integrated circuit for voltage regulation is provided. The integrated circuit includes a power grid, a voltage regulator, and a reference voltage calibration circuit. The power grid has a plurality of supply and ground voltage lines. A first supply voltage line of the plurality of supply voltage lines includes first and second nodes and a first set of electronic components connected therebetween. A first ground voltage line of the plurality of ground voltage lines includes third and fourth nodes and a second set of electronic components connected therebetween. The first and third nodes receive first supply and ground voltage signals, respectively, and have a first electronic circuit module connected therebetween. The second and fourth nodes receive second supply and ground voltage signals, respectively, and have a second electronic circuit module connected therebetween. The voltage regulator has a first input terminal connected to the second node for receiving the second supply voltage signal, a second input terminal for receiving a reference voltage signal, and an output terminal connected to the first node for providing the first supply voltage signal thereto. The reference voltage calibration circuit is connected to the first and third nodes for receiving the first supply and ground voltage signals, respectively, and the second and fourth nodes for receiving the second supply and ground voltage signals, respectively. The reference voltage calibration circuit generates the reference voltage signal based on at least one of a difference between voltage levels of the first supply and ground voltage signals and a difference between voltage levels of the second supply and ground voltage signals.

In another embodiment of the present invention, an integrated circuit for voltage regulation, is provided. The integrated circuit includes a power grid, a voltage regulator, and a reference voltage calibration circuit. The power grid has a plurality of supply and ground voltage lines. A first supply voltage line of the plurality of supply voltage lines includes first and second nodes and a first set of electronic components connected therebetween. A first ground voltage line of the plurality of ground voltage lines includes third and fourth nodes and a second set of electronic components connected therebetween. The first and third nodes receive first supply and ground voltage signals, respectively, and have a first electronic circuit module connected therebetween. The second and fourth nodes receive second supply and ground voltage signals, respectively, and have a second electronic circuit module connected therebetween. The voltage regulator has a first input terminal connected to the second node for receiving the second supply voltage signal, a second input terminal for receiving a reference voltage signal, and an output terminal connected to the first node for providing the first supply voltage signal thereto. The reference voltage calibration circuit includes first and second voltage converters, a programmable reference voltage generator, first and second comparators, first and second flip-flops, and a regulator-reference controller. The first voltage converter is connected to the first and third nodes for receiving the first supply and ground voltage signals, respectively, and generating a first single-ended voltage signal based on a difference between voltage levels of the first supply and ground voltage signals. The second voltage converter is connected to the second and fourth nodes for receiving the second supply and ground voltage signals, respectively, and generating a second single-ended voltage signal based on a difference between voltage levels of the second supply and ground voltage signals. The programmable reference voltage generator generates first and second indicator signals, and the reference voltage signal based on a control signal. The first comparator has a first input terminal connected to the first voltage converter for receiving the first single-ended voltage signal, a second input terminal connected to the programmable reference voltage generator for receiving the first indicator signal, and an output terminal for generating a first trip signal when the first single-ended voltage signal exceeds the first indicator signal. The second comparator has a first input terminal connected to the second voltage converter for receiving the second single-ended voltage signal, a second input terminal connected to the programmable reference voltage generator for receiving the second indicator signal, and an output terminal for generating a second trip signal when the second single-ended voltage signal is less than the second indicator signal. The first flip-flop has a data-input terminal connected to the output terminal of the first comparator for receiving the first trip signal, a clock-input terminal for receiving a read-in signal, and an output terminal for outputting the first trip signal. The second flip-flop has a data-input terminal connected to the output terminal of the second comparator for receiving the second trip signal, a clock-input terminal for receiving the read-in signal, and an output terminal for outputting the second trip signal. The regulator-reference controller is connected to the output terminals of the first and second flip-flops for receiving the first and second trip signals, respectively, at a predefined time interval. The regulator-reference controller is connected to the programmable reference voltage generator for providing a control signal thereto based on the first and second trip signals and receiving the reference voltage signal therefrom. The regulator-reference controller is connected to the second input terminal of the voltage regulator for providing the reference voltage signal thereto.

In yet another embodiment of the present invention, an integrated circuit for monitoring voltage signals, is provided. The integrated circuit includes a power grid, a dual-rail sensing circuit, and a voltage monitor. The power grid has a plurality of supply and ground voltage lines. A first supply voltage line of the plurality of supply voltage lines includes first and second nodes and a first set of electronic components connected therebetween. A first ground voltage line of the plurality of ground voltage lines includes third and fourth nodes and a second set of electronic components connected therebetween. The first and third nodes receive first supply and ground voltage signals, respectively, and have a first electronic circuit module connected therebetween. The second and fourth nodes receive second supply and ground voltage signals, respectively, and have a second electronic circuit module connected therebetween. The dual-rail sensing circuit is connected to the second and fourth nodes for receiving the second supply and ground voltage signals, respectively, and generating a sense voltage signal based on a difference between voltage levels of the second supply and ground voltage signals. The voltage monitor has a first input terminal for receiving an external reference voltage signal, a second input terminal connected to the dual-rail sensing circuit for receiving the sense voltage signal, and an output terminal for generating a voltage monitor signal based on the sense voltage signal. The voltage monitor signal indicates at least one of low voltage, high voltage, and power-on-reset (POR) states of the integrated circuit.

Various embodiments of the present invention provide an integrated circuit for monitoring and regulating voltage signals. The integrated circuit includes a power grid that has a plurality of supply and ground voltage lines. A first supply voltage line of the plurality of supply voltage lines includes first and second nodes and a first set of electronic components connected therebetween. A first ground voltage line of the plurality of ground voltage lines includes third and fourth nodes and a second set of electronic components connected therebetween. The first and third nodes receive first supply and ground voltage signals, respectively, and have a first electronic circuit module connected therebetween. The second and fourth nodes receive second supply and ground voltage signals, respectively, and have a second electronic circuit module connected therebetween. The integrated circuit further includes a voltage regulator, a reference voltage calibration circuit, a voltage monitor, and a dual rail sensing circuit. The reference voltage calibration circuit receives the first and second supply voltage signals and the first and second ground voltage signals from the first, second, third, and fourth nodes respectively, and generates a reference voltage signal based on at least one of a difference between voltage levels of the first supply and ground voltage signals and a difference between voltage levels of the second supply and ground voltage signals. The voltage regulator receives the second supply voltage signal and the reference voltage signal at first and second input terminals thereof and regulates a voltage level of the first supply voltage signal within a predetermined voltage range. Highest and lowest voltage levels of the predetermined voltage range are required to be maintained across the first and second logic circuit modules, respectively, for normal functioning of the integrated circuit. The dual-rail sensing circuit receives the second supply and ground voltage signals from the second and fourth nodes, respectively, and generates a sense voltage signal based on a difference between the voltage levels of the second supply and ground voltage signals. The voltage monitor receives an external reference voltage monitor signal and the sense voltage signal at first and second input terminals, respectively, and generates a voltage monitor signal that indicates at least one of a low voltage and power-on-reset states of the integrated circuit when a voltage level of the sense voltage signal is less than a voltage level of the reference voltage monitor signal and a high voltage state of the integrated circuit when the voltage level of the sense voltage signal is greater than the voltage level of the reference voltage monitor signal. Therefore, the voltage monitor precisely determines a state of the integrated circuit by tracking voltage rise in the second ground voltage signal at the fourth node. The voltage regulator further accurately regulates the voltage level of the first supply voltage signal within the predetermined voltage range, thereby maintaining the reliability and timing specifications of the integrated circuit.

Referring now to FIG. 1, a schematic block diagram of an integrated circuit (IC) 100 for voltage regulation in accordance with an embodiment of the present invention is shown. The IC 100 includes a power grid (not shown) having a plurality of supply and ground voltage lines, first and second logic circuit modules 102 and 104, first and second sets of electronic components 106 and 108, a voltage regulator 110, and a reference voltage calibration circuit 112. A first supply voltage line of the plurality of supply voltage lines includes first and second nodes. The first set of electronic components 106 is connected between the first and second nodes. The first node receives a first supply voltage signal with no IR drop in a corresponding voltage level. The second node receives a second supply voltage signal that has a voltage level equal to a difference between the voltage level of the first supply voltage signal and a voltage drop across the first set of electronic components 106. A first ground voltage line of the plurality of ground voltage lines includes third and fourth nodes. The second set of electronic components 108 is connected between the third and fourth nodes. The third node receives a first ground voltage signal with no IR drop in corresponding voltage level. The fourth node receives a second ground voltage signal that has a voltage level equal to a sum of the voltage level of the first ground voltage signal and a voltage rise across the second set of electronic components 108. In an embodiment of the present invention, the first and second sets of electronic components 106 and 108 each include at least one of a resistor, a capacitor, and an inductor.

The first logic circuit module 102 is connected between the first and third nodes. The second logic circuit module 104 is connected between the second and fourth nodes. The reference voltage calibration circuit 112 is connected to the first, second, third, and fourth nodes for receiving the first supply, second supply, first ground, and second ground voltage signals, respectively. The reference voltage calibration circuit 112 generates a reference voltage signal. The voltage regulator 110 has a first input terminal connected to the second node for receiving the second supply voltage signal, a second input terminal connected to the reference voltage calibration circuit 112 for receiving the reference voltage signal, a first supply input terminal for receiving a third supply voltage signal (hereinafter referred to as $V_{DD1}$), and a second supply input terminal connected to ground for receiving the first ground voltage signal. An output terminal of the voltage regulator 110 is connected to the first node for providing the first supply voltage signal thereto.

In operation, the first logic circuit module 102 receives the first supply voltage signal at the first node from the voltage regulator 110 and the first ground voltage signal at the third node. In an embodiment of the present invention, the first ground voltage signal is at zero voltage level. Hence, a voltage level across the first logic circuit module 102 equals the voltage level of the first supply voltage signal. The second logic circuit module 104 receives the second supply voltage signal at the second node and the second ground voltage signal at the fourth node. The second ground voltage signal has a non-zero voltage level but is less than the voltage level of the first supply voltage signal, and hence a voltage level across the second logic circuit module 104 equals a difference between the voltage levels of the second supply and ground voltage signals. The voltage levels across the first and second logic circuit modules 102 and 104 are required to be within a predetermined voltage range for normal operation of the IC 100. The voltage level across the first logic circuit module 102 and second logic circuit module 104 should be less than a first predetermined voltage level of the predetermined voltage range and should be more than a second predetermined voltage level of the predetermined voltage range, respectively. In an embodiment of the present invention, the first predetermined voltage level refers to the highest voltage level at which the IC 100 starts functioning outside the reliability specifications and the second predetermined voltage level refers to the lowest voltage level at which critical paths of the IC 100 fail corresponding timing constraints.

The reference voltage calibration circuit 112 receives the first supply and ground voltage signals from the first and third nodes, respectively, and the second supply and ground signals from the second and fourth nodes, respectively, and generates the reference voltage signal. The reference voltage calibration circuit 112 increases a voltage level of the reference voltage signal by a predefined step-size when the difference between the voltage levels of the second supply and ground voltage signals is less than the second predetermined voltage level of the predetermined voltage range. The reference voltage calibration circuit 112 decreases the voltage level of the reference voltage signal by the predefined step-size when the difference between the voltage levels of the first supply and ground voltage signals is greater than the first predetermined voltage level of the predetermined voltage range. Hence, the voltage level of the reference voltage signal is calibrated based on at least one of the difference between the voltage levels of the first supply and ground signals and the difference between the voltage levels of the second supply and ground signals. The voltage regulator 110 regulates the voltage level of the first supply voltage signal based on the voltage level of the reference voltage signal. Hence, a variation in the voltage level of the first supply voltage signal generated by the voltage regulator 110 reduces and changes based on the voltage level of the reference voltage signal. As a result an accuracy of the voltage regulator 110 is increased.

Figure 2:
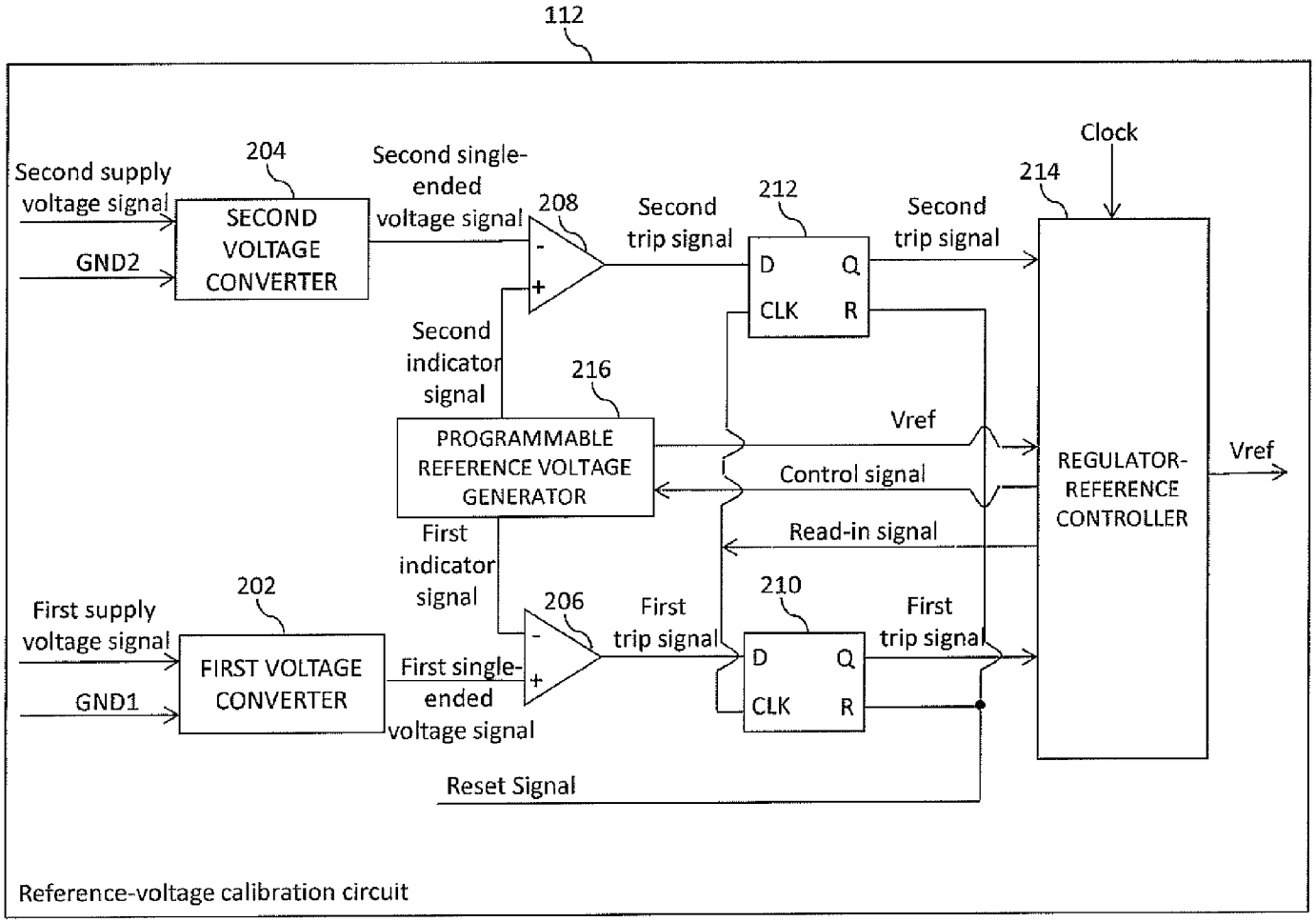
FIG. 2 is a detailed schematic block diagram of a reference voltage calibration circuit of the IC of FIG. 1 in accordance with an embodiment of the present invention.

Referring now to FIG. 2, a detailed schematic block diagram of the reference voltage calibration circuit 112 in accordance with an embodiment of the present invention is shown. The reference voltage calibration circuit 112 includes first and second voltage converters 202 and 204, first and second comparators 206 and 208, first and second D flip-flops 210 and 212, a regulator-reference controller 214, and a programmable reference voltage generator 216. The first voltage converter 202 is connected to the first and third nodes for receiving the first supply and ground voltage signals, respectively, and generates a first single-ended voltage signal based on the difference between the voltage levels of the first supply and ground voltage signals. The second voltage converter 204 is connected to the second and fourth nodes for receiving the second supply and ground voltage signals, respectively and generates a second single-ended voltage signal based on the difference between the voltage levels of the second supply and ground voltage signals. The first comparator 206 has a non-inverting input terminal connected to the first voltage converter 202 for receiving the first single-ended voltage signal, an inverting input terminal connected to the programmable reference voltage generator 216 for receiving a first indicator signal, and an output terminal for generating a first trip signal. The second comparator 208 has a non-inverting input terminal connected to the second voltage converter 204 for receiving the second single-ended voltage signal, an inverting input terminal connected to the programmable reference voltage generator 216 for receiving a second indicator signal, and an output terminal for generating a second trip signal.

The first D flip-flop 210 has a data input terminal connected to the output terminal of the first comparator 206 for receiving the first trip signal, a reset input terminal for receiving an external reset signal, and an output terminal for outputting the first trip signal. The second D flip-flop 212 has a data input terminal connected to the output terminal of the second comparator 208 for receiving the second trip signal, a reset input terminal for receiving the reset signal, and an output terminal for outputting the second trip signal. The regulator-reference controller 214 is connected to the programmable reference voltage generator 216 for providing a control signal and receiving a reference voltage signal. The regulator-reference controller 214 receives an external clock signal. The regulator-reference controller 214 is connected to clock terminals of the first and second D flip-flops 210 and 212 for providing a read-in signal thereto. The read-in signal is a control signal generated by the regulator-reference controller 214. The regulator-reference controller 214 is connected to the output terminals of the first and second D flip-flops 210 and 212 for receiving the first and second trip signals, respectively. The regulator-reference controller 214 outputs the reference voltage signal. In an embodiment of the present invention, the regulator-reference controller 214 is a microcontroller.

In operation, the first voltage converter 202 receives the first supply and ground voltage signals from the first and third nodes, respectively, and generates the first single-ended voltage signal based on the difference between the voltage levels of the first supply and ground voltage signals. The second voltage converter 204 receives the second supply and ground voltage signals from the second and fourth nodes, respectively, and generates the second single-ended voltage signal based on the difference between the voltage levels of the second supply and ground voltage signals. The programmable reference voltage generator 216 generates the first and second indicator signals. The first indicator signal refers to the highest voltage level of the predetermined voltage range and the second indicator signal refers to the lowest voltage level of the predetermined voltage range. The first comparator 206 receives the first single-ended voltage signal and the first indicator signal and generates the first trip signal at logic high state when a voltage level of the first single-ended voltage signal exceeds a voltage level of the first indicator signal. The second comparator 208 receives the second single-ended voltage signal and the second indicator signal and generates the second trip signal at logic high state when a voltage level of the second single-ended voltage signal is less than a voltage level of the second indicator signal.

The first and second D flip-flops 210 and 212 receive the first and second trip signals at corresponding data input terminals. The regulator-reference controller 214 provides the read-in signal to the clock input terminals of the first and second D flip-flops 210 and 212 at a predefined time interval.

When the first D flip-flop 210 is clocked, it outputs the logic high first trip signal to the regulator-reference controller 214 at the predefined time interval. When the regulator-reference controller 214 receives the logic high first trip signal, it generates and provides the control signal to the programmable reference voltage generator 216. The programmable reference voltage generator 216 generates the reference voltage signal by decreasing the voltage level of the reference voltage signal by a predetermined step-size based on the control signal and is referred to as a calibrated reference voltage signal. The regulator-reference controller 214 receives and provides the calibrated reference voltage signal to the second input terminal of the voltage regulator 110. Hence, the voltage regulator 110 regulates the voltage level of the first supply voltage signal below the highest voltage level of the predetermined voltage range, thereby conforming to the reliability specification of the IC 100 and protecting the IC 100 from any damages.

When the second D flip-flop 212 is clocked, it outputs the logic high second trip signal to the regulator-reference controller 214 at the predefined time interval. When the regulator-reference controller 214 receives the logic high second trip signal, it generates and provides the control signal to the programmable reference voltage generator 216. The programmable reference voltage generator 216 generates the reference voltage signal by increasing the voltage level of the reference voltage signal by the predetermined step-size based on the control signal and is referred to as a calibrated reference voltage signal. The regulator-reference controller 214 receives and provides the calibrated reference voltage signal to the second input terminal of the voltage regulator 110. Hence, the voltage regulator 110 regulates the voltage level of the first supply voltage signal above the lowest voltage level of the predetermined voltage range, thereby conforming to the timing constraints of the critical paths of the IC 100. The regulator-reference controller 214 calibrates the reference voltage signal based on multiple pre-programmed algorithms.

Figure 3A:
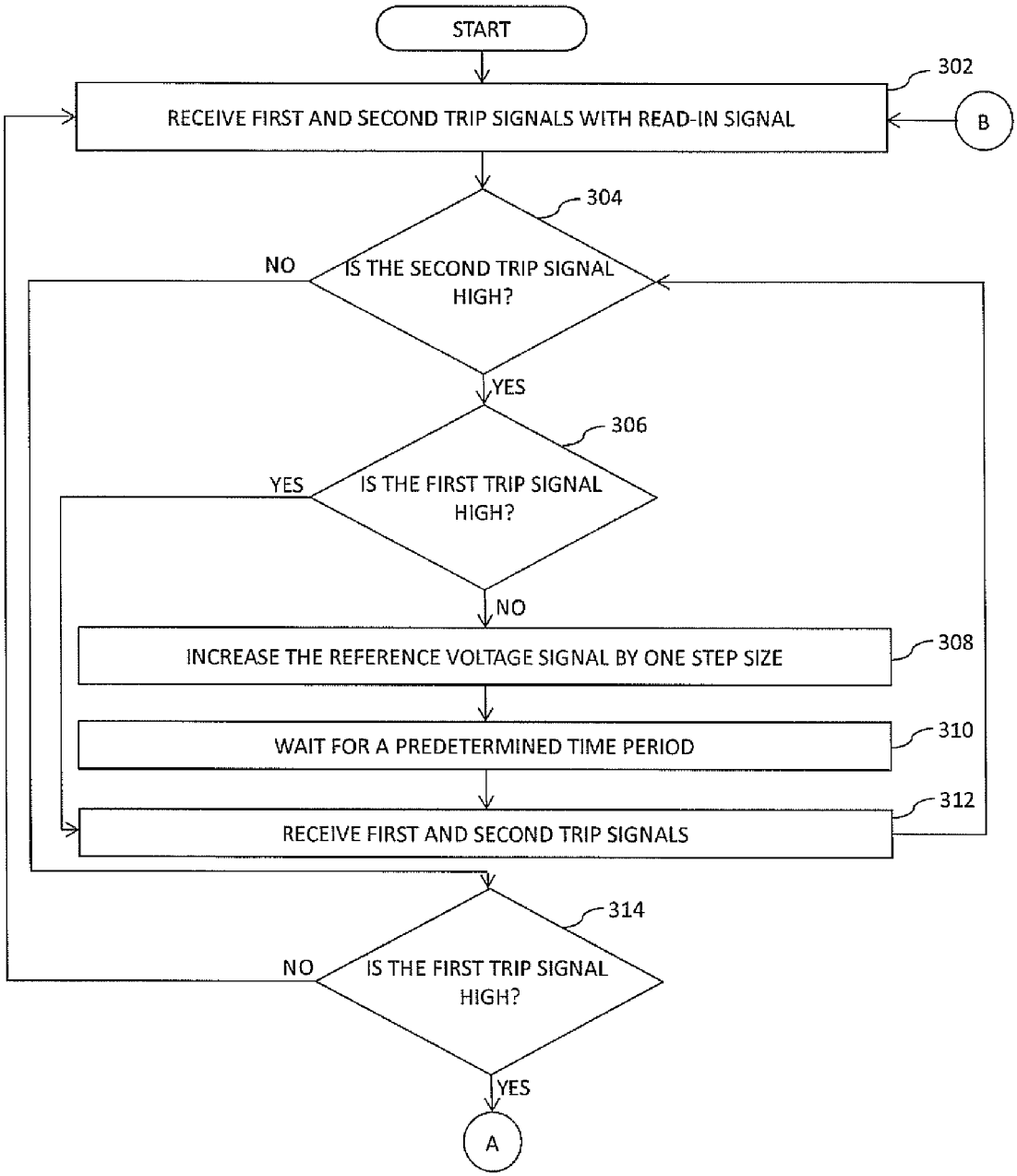
FIGS. 3A and 3B are a flow chart illustrating a method for calibrating a reference voltage signal generated by the reference voltage calibration circuit of FIG. 2 in accordance with an embodiment of the present invention.
Figure 3B:
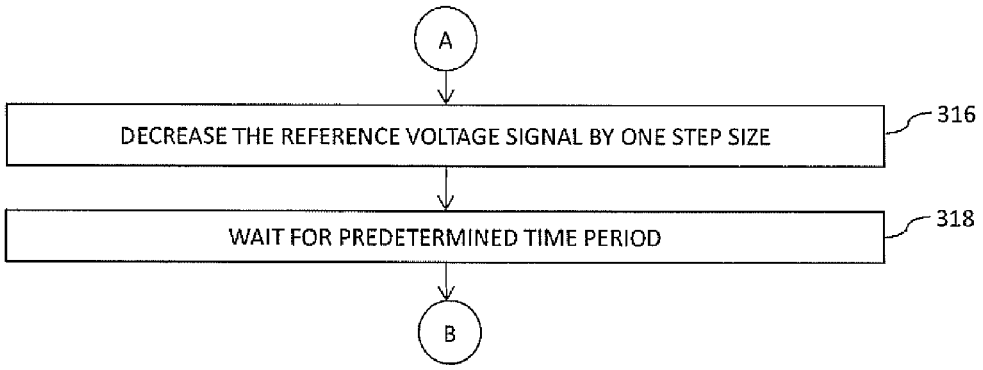

FIGS. 3A and 3B are a flowchart illustrating a method for calibrating the reference voltage signal generated by the reference voltage calibration circuit 112. The method illustrated in FIGS. 3A and 3B correspond to an algorithm of that is pre-programmed in the regulator-reference controller 214. At step 302, the regulator-reference controller 214 receives the first and second trip signals when the first and second D flip-flops 210 and 212 receive the read-in signal. At step 304, a check is performed to determine if the second trip signal is set at logic high state. If at step 304 it is determined that the second trip signal is set at logic high state then step 306 is performed. At step 306, a check is performed to determine if the first trip signal is set at logic high state. If at step 306 it is determined that the first trip signal is set at logic high state then step 312 is performed. At step 312, the regulator-reference controller 214 receives the first and second trip signals after the predetermined time interval. If at step 306 it is determined that the first trip signal is at logic low state then step 308 is performed. At step 308, the regulator-reference controller 214 generates and provides the control signal to the programmable reference voltage generator 216 such that the programmable reference voltage generator 216 increases the voltage level of the reference voltage signal by the pre-defined step size.

At step 310, the first and second D flip-flops 210 and 212 wait for the predetermined time interval to receive the read-in signal from the regulator-reference controller 214. If at step 304 it is determined that the second trip signal is at logic low state then step 314 is performed. At step 314, a check is performed to determine if the first trip signal received at step 312 is at logic high state. If at step 314 it is determined that the first trip signal received at step 312 is at logic low state then step 302 is performed. If at step 314 it is determined that the first trip signal received at step 312 is at logic high state then step 316 is performed. At step 316, the regulator-reference controller 214 generates and provides the control signal to the programmable reference voltage generator 216 such that the programmable reference voltage generator 216 decreases the voltage level of the reference voltage signal by the pre-defined step size. At step 318, the first and second D flip-flops 210 and 212 wait for the predetermined time interval to receive the read-in signal from the regulator-reference controller 214. On receiving the read-in signal, step 302 is repeated and the process continues to calibrate the reference voltage signal.

Figure 4A:
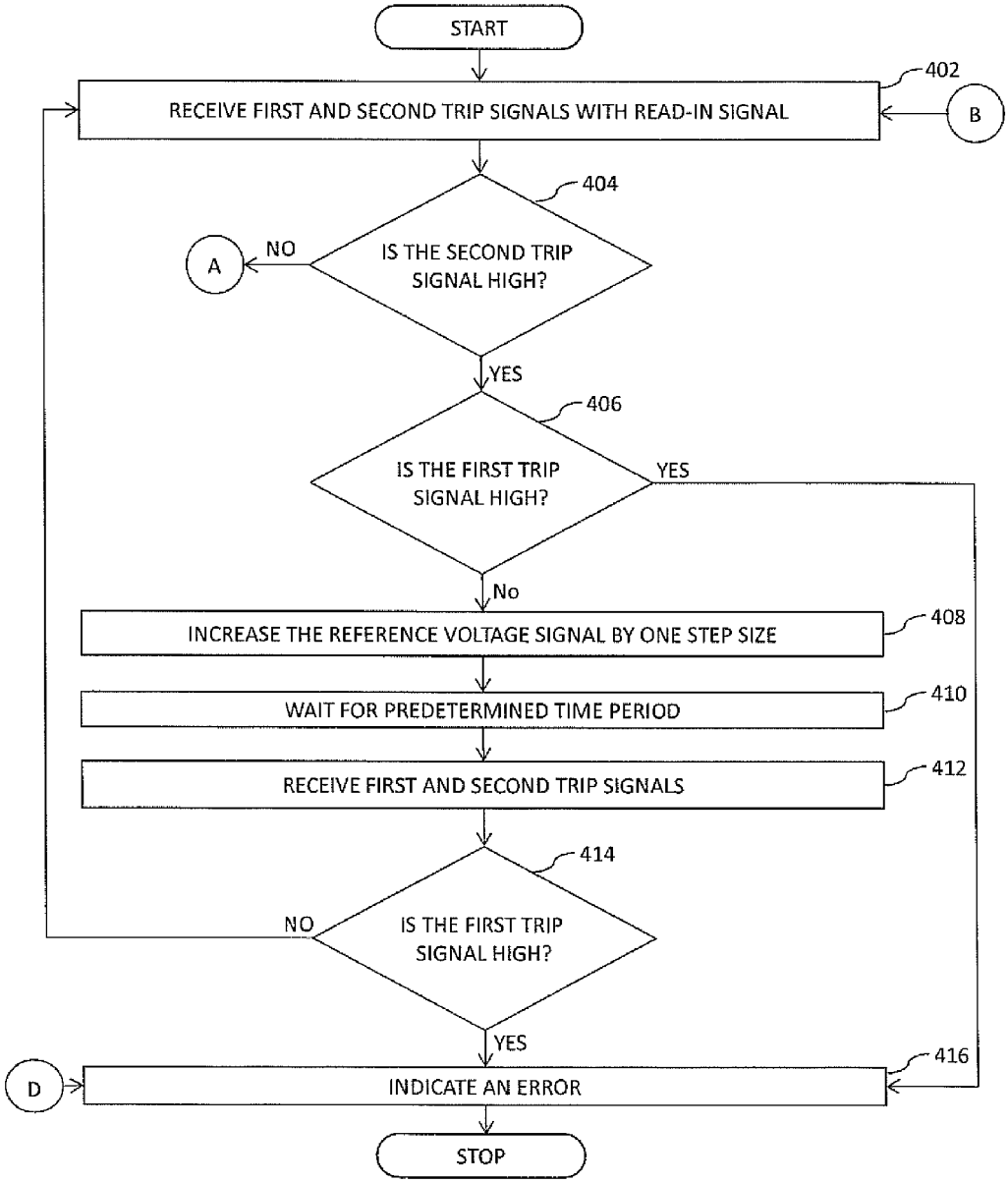
FIGS. 4A and 4B are a flow chart illustrating another method for calibrating the reference voltage signal generated by the reference voltage calibration circuit of FIG. 2 in accordance with an embodiment of the present invention.
Figure 4B:
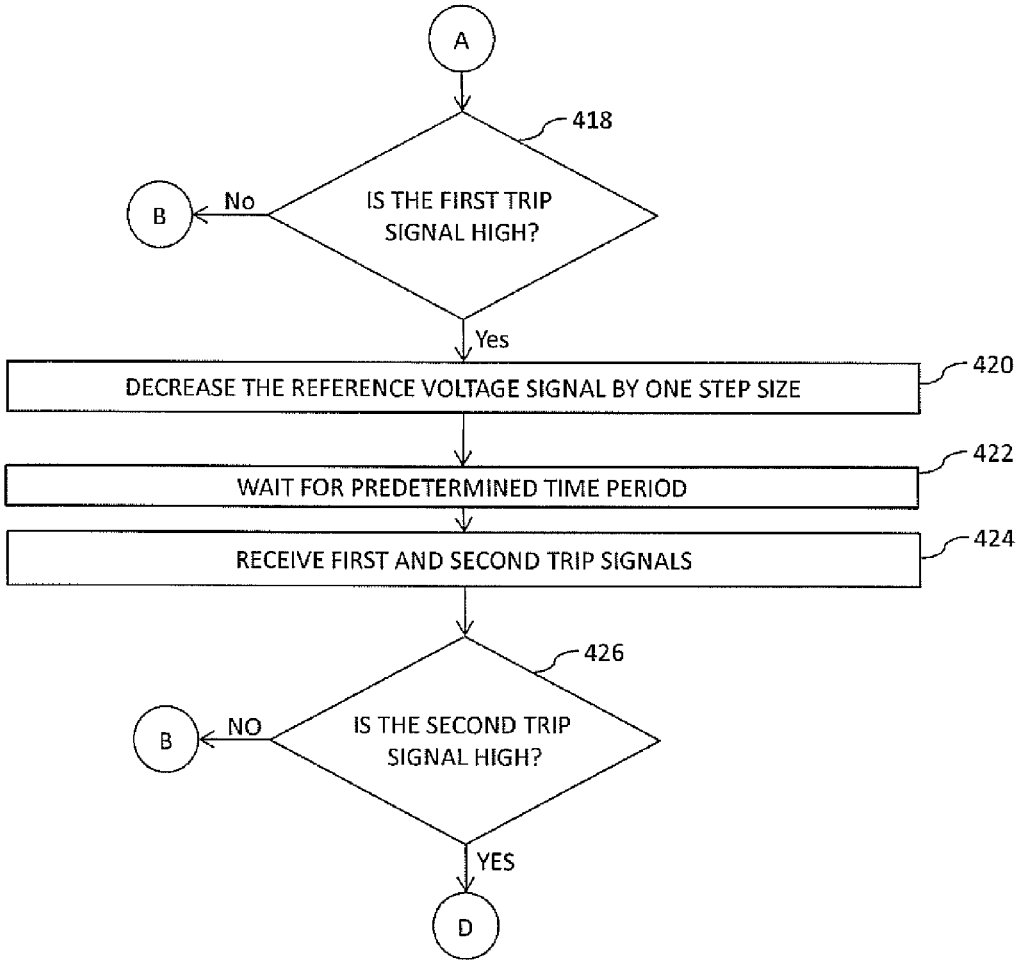

FIGS. 4A and 4B are a flowchart illustrating an alternate method for calibrating the reference voltage signal generated by the reference voltage calibration circuit 112. The method illustrated in FIGS. 4A and 4B corresponds to an alternate algorithm that is pre-programmed in the regulator-reference controller 214. At step 402, the regulator-reference controller 214 receives the first and second trip signals when the read-in signal is set at logic high state. At step 404, a check is performed to determine if the second trip signal is set at logic high state. If at step 404 it is determined that the second trip signal is set at logic high state then step 406 is performed. At step 406, a check is performed to determine if the first trip signal is set at logic high state. If at step 406 it is determined that the first trip signal is set at logic high state then step 416 is performed. At step 416, the regulator-reference controller 214 generates an error signal and the process is halted. If at step 406 it is determined that the second trip signal is set at logic high state then step 408 is performed. At step 408, the regulator-reference controller 214 generates and provides the control signal to the programmable reference voltage generator 216 such that the programmable reference voltage generator 216 increases the voltage level of the reference voltage signal by the pre-defined step size.

At step 410, the first and second D flip-flops 210 and 212 wait for the predetermined time interval to receive the read-in signal from the regulator-reference controller 214. At step 412, the regulator-reference controller 214 receives the first and second trip signals after the predetermined time interval. At step 414, a check is performed to determine if the first trip signal received at step 412 is at logic high state. If at step 414, it is determined that the first trip signal is at logic high state then step 416 is performed. If at step 414, it is determined that the first trip signal is at logic low state then step 402 is performed. If at step 404, it is determined that the second trip signal is at logic low state then step 418 is performed. At step 418, a check is performed to determine if the first trip signal is set at logic high state. If at step 418 it is determined that the first trip signal is set at logic low state then step 402 is performed. If at step 418 it is determined that the first trip signal is set at logic high state then step 420 is performed. At step 420, the regulator-reference controller 214 generates and provides the control signal to the programmable reference voltage generator 216 such that the programmable reference voltage generator 216 decreases the voltage level of the reference voltage signal by the pre-defined step size. At step 422, the first and second D flip-flops 210 and 212 wait for the predetermined time interval to receive the read-in signal from the regulator-reference controller 214. At step 424, the regulator-reference controller 214 receives the first and second trip signals after the predetermined time interval. At step 426, a check is performed to determine if the second trip signal is set at logic high state. If at step 426 it is determined that that the second trip signal is set at logic high state then step 416 is performed. If at step 426 it is determined that that the second trip signal is set at logic low state then step 402 is performed.

Figure 5:
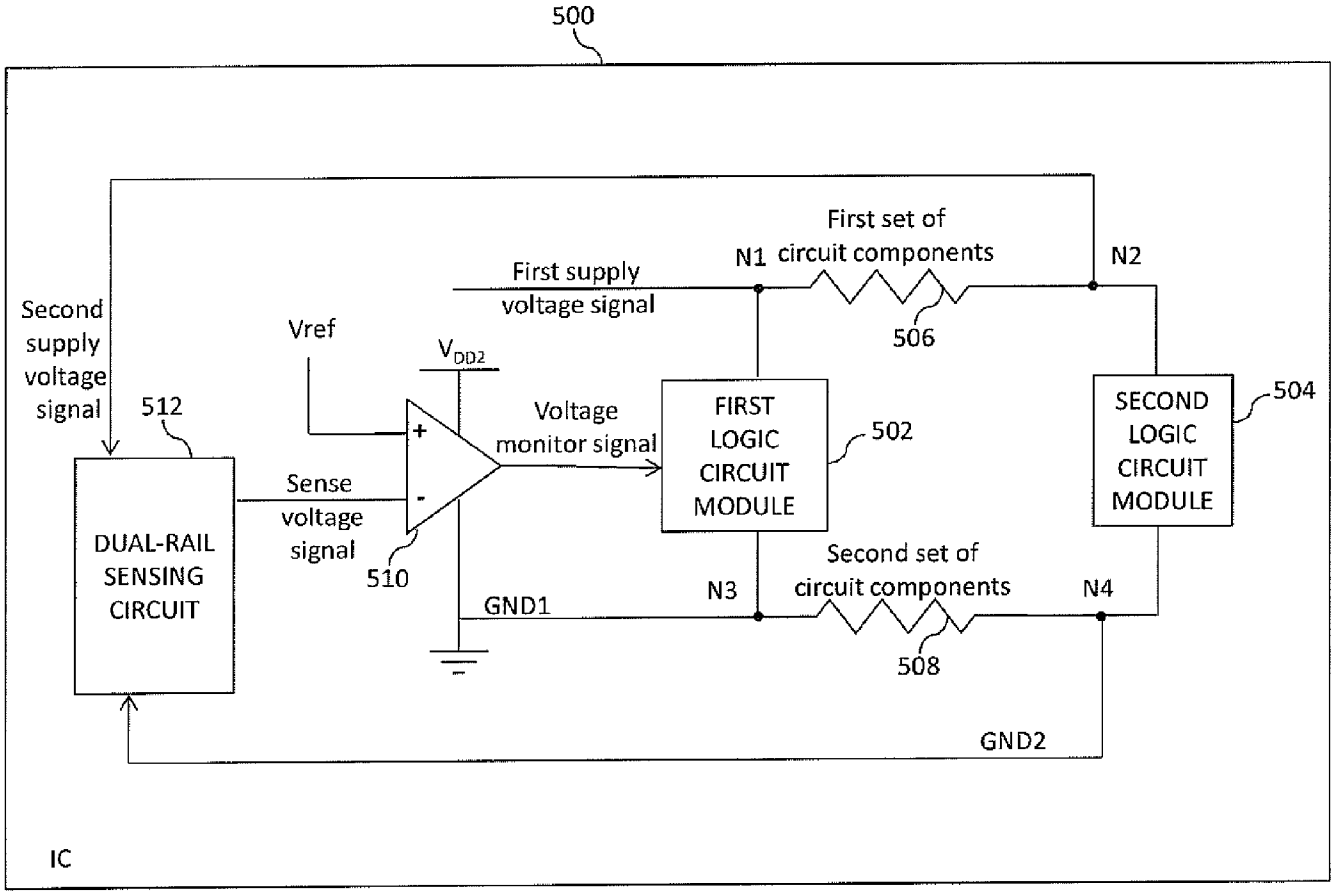
FIG. 5 is a schematic block diagram of an IC for monitoring voltage signals in accordance with an embodiment of the present invention.

Referring now to FIG. 5, a schematic block diagram of an integrated circuit (IC) 500 for monitoring multiple voltage signals in accordance with another embodiment of the present invention is shown. The IC 500 includes a power grid (not shown) having a plurality of supply and ground voltage lines, first and second logic circuit modules 502 and 504, first and second sets of electronic components 506 and 508, a voltage monitor 510, and a dual rail sensing circuit 512. A first supply voltage line of the plurality of supply voltage lines includes first and second nodes. The first set of electronic components 506 is connected between the first and second nodes. The first node receives a first supply voltage signal with no IR drop in a corresponding voltage level. The second node receives a second supply voltage signal that is equal to a difference between a voltage level of the first supply voltage signal and a voltage drop across the first set of electronic components 506. A first ground voltage line of the plurality of ground voltage lines includes third and fourth nodes. The second set of electronic components 508 is connected between the third and fourth nodes. The third node receives a first ground voltage signal with no IR drop in a corresponding voltage level. The fourth node receives a second ground voltage signal that is equal to a sum of a voltage level of the first ground voltage signal and a voltage rise across the second set of electronic components 508. In an embodiment of the present invention, the first and second sets of electronic components 506 and 508 each include at least one of a resistor, a capacitor, and an inductor.

The first logic circuit module 502 is connected between the first and third nodes. The second logic circuit module 504 is connected between the second and fourth nodes. The dual-rail sensing circuit 512 is connected to the second and fourth nodes for receiving the second supply and ground voltage signals, respectively. The dual-rail sensing circuit 512 generates a sense voltage signal. The voltage monitor 510 has a non-inverting input terminal for receiving an external reference voltage signal, an inverting input terminal connected to the dual-rail sensing circuit 512 for receiving the sense voltage signal, a first supply input terminal for receiving a third supply voltage signal (hereinafter referred to as $V_{DD2}$), a second supply input terminal connected to ground, and an output terminal for outputting a voltage monitor signal. In an embodiment of the present invention, the dual-rail sensing circuit 512 includes a resistors, capacitors, and voltage amplifiers and the voltage monitor 510 includes at least one of a high voltage detector (HVD), a low voltage detector (LVD), and a power-on-reset (POR) monitor.

In operation, the first logic circuit module 502 receives the first supply voltage signal at the first node and the first ground voltage signal at the third node. In an embodiment of the present invention, the first ground voltage signal is at a zero voltage level. Hence, a voltage across the first logic circuit module 502 equals the voltage level of the first supply voltage signal. The second logic circuit module 504 receives the second supply voltage signal at the second node and the second ground voltage signal at the fourth node. The second ground voltage signal has a non-zero voltage level, and hence a voltage level across the second logic circuit module 504 equals a difference between the voltage levels of the second supply and ground voltage signals. The voltage levels across the first and second logic circuit modules 502 and 504 are required to be within a predetermined voltage range for normal operation of the IC 500. The voltage level across the first logic circuit module 502 should be less than a first predetermined voltage level of the predetermined voltage range. The voltage level across the second logic circuit module 504 should be less than a second predetermined voltage level of the predetermined voltage range. In an embodiment of the present invention, the first predetermined voltage level refers to the highest voltage level at which the IC 500 starts failing corresponding reliability specifications and the second predetermined voltage level refers to the lowest voltage level at which critical paths of the IC 500 fail corresponding timing constraints.

The dual-rail sensing circuit 512 receives the second supply and ground signals from the second and fourth nodes, respectively, and generates the sense voltage signal based on a difference between the voltage levels of the second supply and ground voltage signals. The voltage monitor 510 receives the sense voltage signal at the second input terminal. The voltage monitor 510 generates the voltage monitor signal based on the sense voltage signal. The voltage monitor signal indicates at least one of low voltage and power-on-reset states of the IC 500 when a voltage level of the sense voltage signal is less than a voltage level of the reference voltage signal of the voltage monitor 510. The voltage monitor 510 indicates a high voltage state of the IC 500 by way of the voltage monitor signal, when the voltage level of the sense voltage signal exceeds the voltage level of the reference voltage signal of the voltage monitor 510. Hence, the sense voltage signal is generated based on the voltage levels of the second supply and ground signals, thereby accounting for the rise in the voltage level of the second ground signal at the fourth node due to the IR drop in the ground voltage lines. Hence, the voltage monitor 510 correctly indicates at least one of the low voltage, high voltage, and POR states of the IC 500, by way of the voltage monitor signal. Thus, a precision of the voltage monitor 510 is increased.

While various embodiments of the present invention have been illustrated and described, it will be clear that the present invention is not limited to these embodiments only. Numerous modifications, changes, variations, substitutions, and equivalents will be apparent to those skilled in the art, without departing from the spirit and scope of the present invention, as described in the claims.

The invention claimed is:

1. An integrated circuit, comprising:

a power grid having a plurality of supply and ground voltage lines, wherein a first supply voltage line of the plurality of supply voltage lines includes first and second nodes and a first set of electronic components connected therebetween, and a first ground voltage line of the plurality of ground voltage lines includes third and fourth nodes and a second set of electronic components connected therebetween, and wherein the first and third nodes receive first supply and ground voltage signals, respectively, and have a first electronic circuit module connected therebetween, and the second and fourth nodes receive second supply and ground voltage signals, respectively, and have a second electronic circuit module connected therebetween;

a voltage regulator having a first input terminal connected to the second node for receiving the second supply voltage signal, a second input terminal for receiving a reference voltage signal, and an output terminal connected to the first node for providing the first supply voltage signal thereto; and a reference voltage calibration circuit, connected to the first and third nodes for receiving the first supply and ground voltage signals, respectively, the second and fourth nodes for receiving the second supply and ground voltage signals, respectively, and generating the reference voltage signal based on at least one of a difference between voltage levels of the first supply and ground voltage signals and a difference between voltage levels of the second supply and ground voltage signals.

2. The integrated circuit of claim 1, wherein the reference voltage calibration circuit, comprises:

a first voltage converter, connected to the first and third nodes for receiving the first supply and ground voltage signals, respectively, and generating a first single-ended voltage signal based on the difference between the voltage levels of the first supply and ground voltage signals;

a second voltage converter, connected to the second and fourth nodes for receiving the second supply and ground voltage signals, respectively, and generating a second single-ended voltage signal based on the difference between the voltage levels of the second supply and ground voltage signals;

a programmable reference voltage generator for generating first and second indicator signals, and the reference voltage signal based on a control signal;

a first comparator having a first input terminal connected to the first voltage converter for receiving the first single-ended voltage signal, a second input terminal connected to the programmable reference voltage generator for receiving the first indicator signal, and an output terminal for generating a first trip signal when a voltage level of the first single-ended voltage signal exceeds a voltage level of the first indicator signal;

a second comparator having a first input terminal connected to the second voltage converter for receiving the second single-ended voltage signal, a second input terminal connected to the programmable reference voltage generator for receiving the second indicator signal, and an output terminal for generating a second trip signal when a voltage level of the second single-ended voltage signal is less than a voltage level of the second indicator signal;

a first flip-flop, having a data-input terminal connected to the output terminal of the first comparator for receiving the first trip signal, a clock-input terminal for receiving a read-in signal, and an output terminal for outputting the first trip signal;

a second flip-flop having a data input terminal connected to the output terminal of the second comparator for receiving the second trip signal, a clock input terminal for receiving the read-in signal, and an output terminal for outputting the second trip signal; and a regulator-reference controller, connected to the output terminals of the first and second flip-flops for receiving the first and second trip signals, respectively, at a predefined time interval, the programmable reference voltage generator for providing a control signal thereto based on the first and second trip signals and receiving the reference voltage signal therefrom, and the second input terminal of the voltage regulator for providing the reference voltage signal thereto.

3. The integrated circuit of claim 2, wherein a voltage level of the second supply voltage signal is equal to a difference between a voltage level of the first supply voltage signal and a voltage drop across the first set of electronic components and a voltage level of the second ground voltage signal is equal to a sum of a voltage level of the first ground voltage signal and a voltage rise across the second set of electronic components.

4. The integrated circuit of claim 3, wherein the regulator-reference controller provides the read-in signal to the clock-input terminals of the first and second flip-flops at the predetermined time interval.

5. The integrated circuit of claim 4, wherein the first trip signal is at logic high state when the voltage level of the first single-ended voltage signal is greater than the voltage level of the first indicator signal and the second trip signal is at logic high state when the voltage level of the second single-ended voltage signal is less than the voltage level of the second indicator signal.

6. The integrated circuit of claim 5, wherein the programmable reference voltage generator increases a voltage level of the reference voltage signal by a predetermined step-size when the second trip signal is at logic high state.

7. The integrated circuit of claim 6, wherein the programmable reference voltage generator decreases the voltage level of the reference voltage signal by the predetermined step-size when the first trip signal is at logic high state.

8. The integrated circuit of claim 1, wherein the first and second sets of electronic components each include at least one of a resistor, a capacitor, and an inductor.

9. An integrated circuit, comprising:

a power grid having a plurality of supply and ground voltage lines, wherein a first supply voltage line of the plurality of supply voltage lines includes first and second nodes and a first set of electronic components connected therebetween, and a first ground voltage line of the plurality of ground voltage lines includes third and fourth nodes and a second set of electronic components connected therebetween, and wherein the first and third nodes receive first supply and ground voltage signals, respectively, and have a first electronic circuit module connected therebetween, and the second and fourth nodes receive second supply and ground voltage signals, respectively, and have a second electronic circuit module connected therebetween;

a voltage regulator having a first input terminal connected to the second node for receiving the second supply voltage signal, a second input terminal for receiving a reference voltage signal, and an output terminal connected to the first node for providing the first supply voltage signal thereto; and a reference voltage calibration circuit for generating the reference voltage signal, comprising:

a first voltage converter, connected to the first and third nodes for receiving the first supply and ground voltage signals, respectively, and generating a first single-ended voltage signal based on a difference between voltage levels of the first supply and ground voltage signals;

a second voltage converter, connected to the second and fourth nodes for receiving the second supply and ground voltage signals, respectively, and generating a second single-ended voltage signal based on a difference between voltage levels of the second supply and ground voltage signals;

a programmable reference voltage generator for generating first and second indicator signals, and the reference voltage signal based on a control signal;

a first comparator having a first input terminal connected to the first voltage converter for receiving the first single-ended voltage signal, a second input terminal connected to the programmable reference voltage generator for receiving the first indicator signal, and an output terminal for generating a first trip signal when a voltage level of the first single-ended voltage signal exceeds a voltage level of the first indicator signal;

a second comparator having a first input terminal connected to the second voltage converter for receiving the second single-ended voltage signal, a second input terminal connected to the programmable reference voltage generator for receiving the second indicator signal, and an output terminal for generating a second trip signal when a voltage level of the second single-ended voltage signal is less than a voltage level of the second indicator signal;

a first flip-flop having a data-input terminal connected to the output terminal of the first comparator for receiving the first trip signal, a clock-input terminal for receiving a read-in signal, and an output terminal for outputting the first trip signal;

a second flip-flop having a data-input terminal connected to the output terminal of the second comparator for receiving the second trip signal, a clock-input terminal for receiving the read-in signal, and an output terminal for outputting the second trip signal; and a regulator-reference controller, connected to the output terminals of the first and second flip-flops for receiving the first and second trip signals, respectively, at a predefined time interval, wherein the programmable reference voltage generator provides a control signal thereto based on the first and second trip signals and receiving the reference voltage signal therefrom, and the second input terminal of the voltage regulator for providing the reference voltage signal thereto.

10. The integrated circuit of claim 9, wherein a voltage level of the second supply voltage signal is equal to a difference between a voltage level of the first supply voltage signal and a voltage drop across the first set of electronic components and a voltage level of the second ground voltage signal is equal to a sum of a voltage level of the first ground voltage signal and a voltage rise across the second set of electronic components.

11. The integrated circuit of claim 10, wherein the regulator-reference controller provides the read-in signal to the clock-input terminals of the first and second flip-flops at the predetermined time interval.

12. The integrated circuit of claim 11, wherein the first trip signal is at logic high state when the voltage level of the first single-ended voltage signal is greater than the voltage level of the first indicator signal and the second trip signal is at logic high state when the voltage level of the second single-ended voltage signal is less than the voltage level of the second indicator signal.

13. The integrated circuit of claim 12, wherein the programmable reference voltage generator increases a voltage level of the reference voltage signal by a predetermined step-size when the second trip signal is at logic high state.

14. The integrated circuit of claim 13, wherein the programmable reference voltage generator decreases the voltage level of the reference voltage signal by the predetermined step-size, when the first trip signal is at logic high state.

* * * * *